US006159418A

United States Patent [19]

Zacharias

[11] Patent Number: 6,159,418

[45] Date of Patent: Dec. 12, 2000

[54] TUNDISH IMPACT PAD

[75] Inventor: Donald R. Zacharias, Parma, Ohio

[73] Assignee: Foseco International Limited, Wiltshire, United Kingdom

[21] Appl. No.: 09/155,761

[22] PCT Filed: Apr. 1, 1997

[86] PCT No.: PCT/GB97/00899

§ 371 Date: Oct. 5, 1998

§ 102(e) Date: Oct. 5, 1998

[87] PCT Pub. No.: WO97/37799

PCT Pub. Date: Oct. 16, 1997

[30] Foreign Application Priority Data

Apr. 11, 1996 [GB] United Kingdom ..... 9607556

[51] Int. Cl.[7] ..... B22D 41/00

[52] U.S. Cl. ..... 266/275; 222/594

[58] Field of Search ..... 222/594; 266/236, 266/275

[56] References Cited

U.S. PATENT DOCUMENTS 5,169,591 12/1992 Schmidt et al. .
5,358,551 10/1994 Saylor .

FOREIGN PATENT DOCUMENTS 0 535 792 4/1993 European Pat. Off. .
WO 97 07915 3/1997 WIPO .

OTHER PUBLICATIONS

"Taming the Thunder" Isenberg–O'Loughlin, Metal Producing, No. 33., pp 21–23 and 47, Sep. 1994.

"Dishing it Out" Isenberg–O'Loughlin, Metal Producing, No. 33, pp 23–25 and 78, Feb. 1996.

*Primary Examiner*—Scott Kastler
*Attorney, Agent, or Firm*—Nixon & Vanderhye P.C.

[57] ABSTRACT

A tundish impact pad comprises the body of refractory material capable of withstanding contact with molten steel. The body comprises a base having an impact surface for molten steel, and an outer side wall extending upwardly from the impact surface. The outer side wall extends around the base to completely enclose it, an annular body portion connected to the side wall and providing a top surface substantially parallel to the impact surface and defining an opening into which molten steel can be poured. The lower surface of the annular body portion and the inner face of the side wall define a recess having an undercut portion extending continuously around and above the impact surface. A first portion of the top surface is at a lower level than the remainder at the top surface and the recess beneath the first portion of the top surface has a smaller cross-section than the remainder of the recess. The impact pad is particularly useful with a longitudinally-extending tundish having a steel inlet zone toward the end opposite to the outlet zone(s).

20 Claims, 2 Drawing Sheets

TUNDISH IMPACT PAD

CROSS-REFERENCE TO RELATED APPLICATION

This application is the U.S. national phase of PCT/GB97/00899 with the international filing date of Apr. 1, 1997.

BACKGROUND AND SUMMARY OF THE INVENTION

This invention relates to a tundish impact pad, i.e. a pad of erosion resistant material positioned on the floor of a tundish to receive the incoming stream of molten metal poured into the tundish from a ladle.

There have been various recent proposals to improve the design of impact pads, particularly with a view to eliminating, or at least reducing, surface turbulence in a continuous casting tundish, to minimise slag entrainment within the liquid steel bath in the tundish, to prevent break-up of tundish flux cover and reoxidation of the liquid steel bath and to ensure a proper flow path. These designs, essentially, have included a base for the pad and upstanding walls around the perimeter of the base to define an opening into which the molten metal stream is received.

Thus, for example, in U.S. Pat. No. 5,169,591 is disclosed an impact pad having a base to receive an incoming ladle stream and one or more sidewalls extending upwardly along the periphery of the base. Each sidewall has an inner surface having an undercut portion facing the incoming ladle stream and extending along the length of the inner surface, thereby providing a shaped surface to receive and reverse the direction of fluid flow generated by the incoming ladle stream.

U.S. Pat. No. 5,358,551 discloses an impact pad having a bottom impact surface and an endless sidewall extending upwardly from the bottom impact surface and defining an opening into which molten metal is poured. The inner surface of the endless sidewall includes an annular portion which extends inwardly and upwardly towards the opening. Preferably the inner surface of the sidewall curves continuously from the bottom impact surface to a vertical wall defining the opening.

It is an object of the present invention to provide an improved impact pad.

It is a further object to provide an impact pad which results in improved flow characteristics of molten steel poured into a tundish, particularly for a longitudinally-extending tundish in which the steel input zone and steel outlet zone(s) are towards opposite ends of the tundish.

Accordingly, in one aspect the invention provides a tundish impact pad comprising a body of refractory material capable of withstanding contact with molten steel, the body comprising a base having an impact surface for molten steel, an outer sidewall extending upwardly from the impact surface, the outer sidewall extending around the base to completely enclose it, an annular body portion connected to the sidewall and providing a top surface substantially parallel to the impact surface and defining an opening into which molten steel can be poured, the lower face of the annular body portion and the inner face of the sidewall defining a recess having an undercut portion extending continuously around and above the impact surface, characterised in that a portion of the top surface is at a lower level than the remainder of the top surface and the recess beneath the portion of the top surface is of smaller cross-section than the remainder of the recess.

Preferably the lower face of the annular body portion and the inner face of the sidewall provide a continuous curved surface which, at its lower end, merges into the impact surface of the base thereby providing a concave recess around the base, the recess having two discontinuities or steps, i.e. one at each end of the smaller recess portion.

The impact pad is preferably four-sided in plan view and, in a particularly preferred embodiment, it has one pair of parallel sides, (defined by the outer surface of the sidewall) i.e. it is wedge-shaped. In this latter embodiment, the longer parallel side preferably includes the first portion of the top surface, i.e. includes the lower top surface portion, and the smaller recess. Alternatively, the pad may be, for example, rectangular in plan view.

The smaller recess is preferably not coterminous with the lower top surface portion and it is especially preferred that the smaller recess portion does not extend as far as the ends of the lower top surface portion, i.e. the smaller recess portion is not as long as the lower top surface. Thus, in the preferred wedge-shaped pad construction, the lower top surface portion stops a little short of each end of that sidewall to provide a step up to a top surface level with the remainder of the surface extending around the other sides of the pad and the smaller recess portion extends underneath the lower top surface portion sufficiently that each of its ends overlaps the recess in its respective adjacent side of the pad but stops short of the aforesaid step.

In this embodiment, therefore, there is in effect a cut-out portion in the top surface along one of the four sides of the pad.

As indicated above, the impact pad of the invention is particularly intended for use with a longitudinally-extending tundish having a steel inlet zone towards the end opposite to the outlet zone(s).

Accordingly, in another aspect the invention provides a tundish having an inlet zone adjacent a first end thereof and an outlet zone adjacent the opposite end thereof, an impact pad positioned on the floor of the tundish in the inlet zone, the impact pad comprising a body of refractory material capable of withstanding contact with molten steel, the body comprising a base having an impact surface for molten steel, an outer sidewall extending upwardly from the impact surface, the outer sidewall extending around the base to completely enclose it, an annular body portion connected to the sidewall and providing a top surface substantially parallel to the impact surface and defining an opening into which molten steel can be poured, the lower face of the annular body portion and the inner face of the sidewall defining a recess having an undercut portion extending continuously around and above the impact surface, characterised in that a portion of the top surface is at a lower level than the remainder of the top surface and the recess beneath the portion of the top surface is of smaller cross-section than the remainder of the recess and the pad is positioned with the first portion of the top surface facing to the first end of the tundish.

In the particularly preferred embodiment, therefore, where the impact pad is of wedge-shape, the longer parallel side of the pad is positioned facing the first end of the tundish.

The impact pads of the invention have been found to be particularly useful in reducing surface turbulence in tundishes of the type described above and are equally useful in tundishes which are generally rectangular in plan view and tundishes which are generally of wedge shape, i.e. with two parallel sides, in plan view. Moreover, the flow patterns of the molten metal within the tundish can be improved over those resulting from use of conventional impact pads.

The impact pads may be formed from a castable refractory composition capable of withstanding continuous contact with molten metal, in particular molten steel such as is used in continuous casting operations. Usually a standard medium-to-high alumina refractory with an alumina content in the range of about 55% to 85% by weight is desirable. Where a basic refractory is preferred because of steel chemistry, it is preferred that a magnesia-based refractory composition be utilised, with MgO in the range of about 58% to 93% by weight.

The invention is now described by way of example only with reference to the accompanying drawings in which:

DETAILED DESCRIPTION OF THE DRAWINGS

Figure 3:
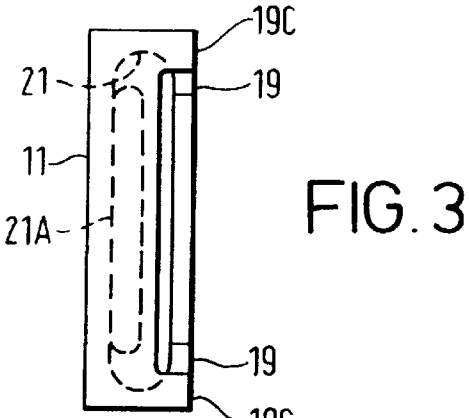
FIG. 3 is a view in the direction of arrow A of FIG. 1.

In FIGS. 1 to 4, a tundish impact pad 10 is of wedge-shaped plan form having two parallel sides 11 and 12, of which side 11 is longer, and two non-parallel sides 13 and 14 of equal length.

The pad has a base 15 and an impact surface 16 to receive a stream of molten steel. An outer sidewall 17 extends upwardly from the impact surface 16 and extends completely around the base, i.e. it provides all four sides 11, 12, 13 and 14 of the pad. An annular body portion 18 is connected to the side wall and provides a top surface 19 substantially parallel to impact surface 16 and defines an opening 20 into which molten steel can be poured.

The lower face of the annular body portion 18 and the inner face of the sidewall 17 define a recess 21 having an undercut portion 22 which extends around and above impact surface 16.

The longer side 11 of the pad has a sidewall 17A connected to an annular body portion 18A having top surface 19A at a lower level than the remainder of the top surface 19. The lower face of annular body portion 18A and the inner face of sidewall 17A define a recess 21A having an undercut portion 22A. Recess 21A is of smaller cross-section than recess 21.

Figure 4:
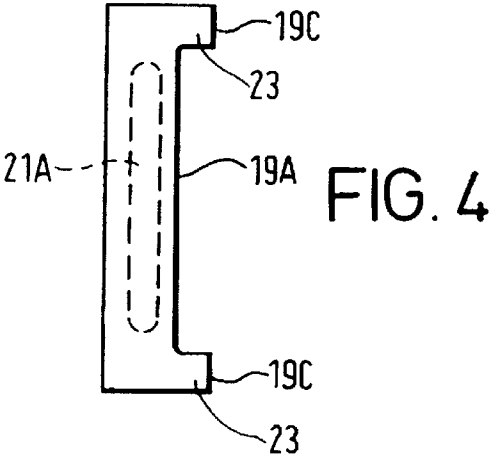
FIG. 4 is a diagrammatic end profile of the pad in the direction of arrow A in FIG. 3.
Figure 1:
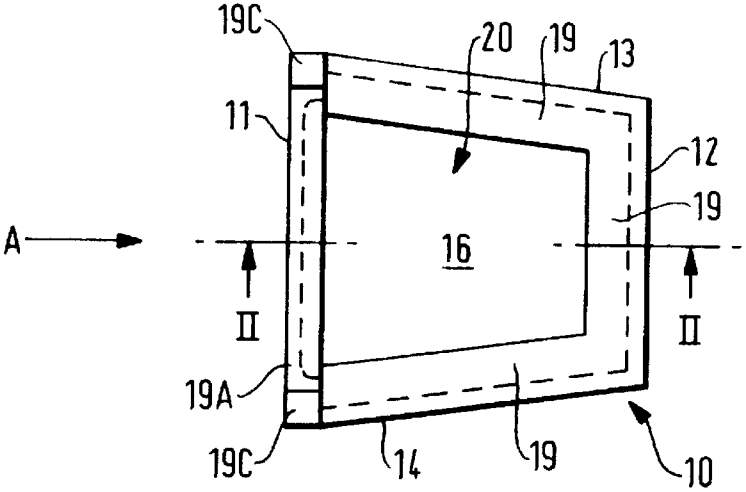
FIG. 1 is a plan view of an impact pad of the invention.
Figure 2:
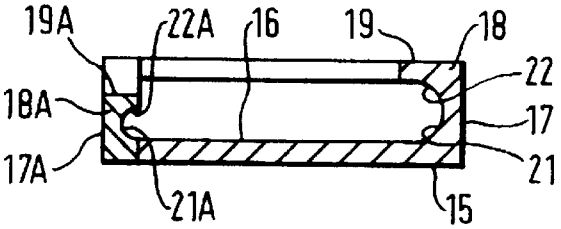
FIG. 2 is a section on line II—II of FIG. 1.

As shown most clearly in FIGS. 1 and 4, the lower top surface 19A does not extend for the full length of side 11 of the pad. It stops a little short of each end of that side to provide a step 23 up to a corner top surface portion 19C which is level with surface 19 extending around the other sides of the pad.

As shown most clearly in FIGS. 1 and 3, recess 21A extends beneath top surface 19A but stops short of step 19C at each end of top surface 19A. It does, however, extend sufficiently to overlap with recess 21 in the sidewalls 17 of sides 13 and 14 of the pad.

Figure 5:
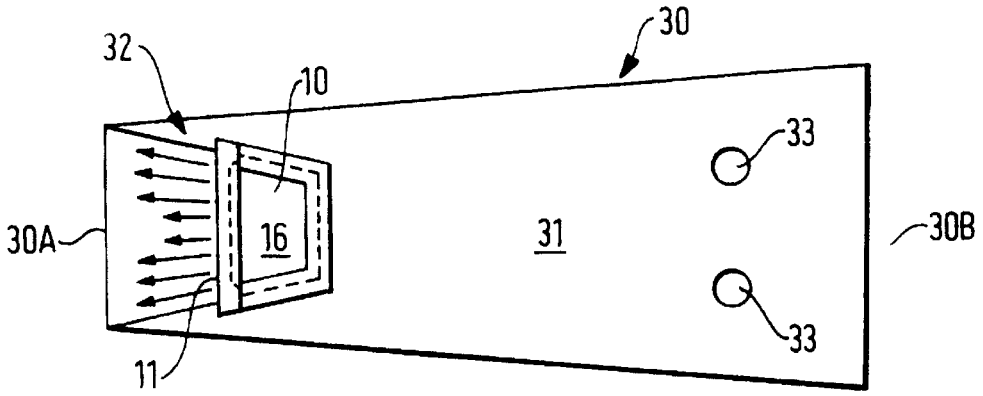
FIG. 5 is a plan view of one form of tundish of the invention.

FIG. 5 shows the impact pad 10 of FIGS. 1 to 4 in position on the floor 31 of a tundish 30. The tundish is longitudinally-extending and wedge shape in plan and has an inlet region 32 adjacent its narrow end 30A and two outlets 33 towards its wider end 30B. Impact pad 10 is positioned in the inlet region 32 with its longer side 11 facing narrow end 30A of the tundish.

Figure 6:
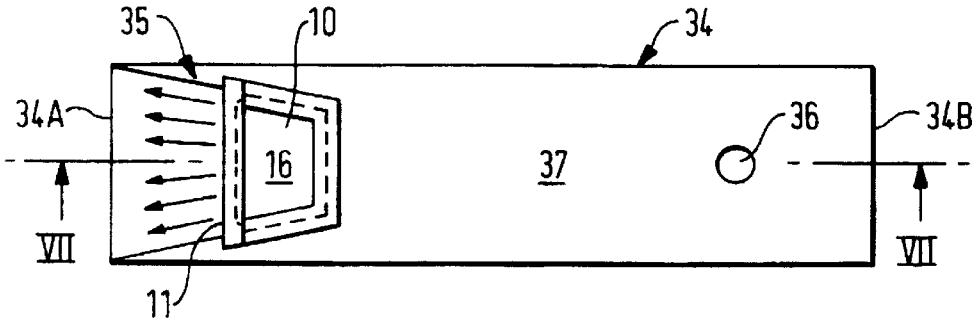
FIG. 6 is a plan view of another form of tundish of the invention.
Figure 7:
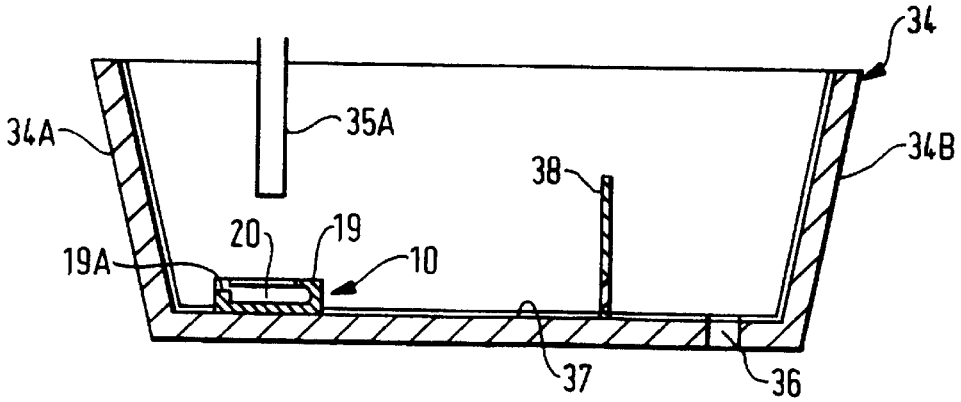
FIG. 7 is a section on line VII—VII of FIG. 6.

FIGS. 6 and 7 show a similar arrangement for a tundish 34 of rectangular plan. This tundish has an inlet region 35 and an outlet 36 towards its opposite ends 34A and 34B respectively. Impact pad 10 is again positioned on floor 37 in the inlet region with its longer side 11 facing end wall 34A of the tundish.

The tundish in FIG. 7 is shown to have a pouring tube 35A to direct incoming steel into the impact pad 10 and a dam 38, which may be provided where necessary and as is conventionally known.

Steel flowing into impact pad 10 flows outwardly towards the sidewalls after hitting impact surface 16 and is then turned in recesses 21 and 21A to flow out of the pad over surfaces 19 and 19A. As indicated by the arrows in FIGS. 5 and 6, flow towards walls 30A and 34A respectively is over lower top surface 19A.

This arrangement has been found to reduced markedly the surface turbulence created in the tundish and the improved flow paths created result in cleaner steel production.

What is claimed is:

1. A tundish impact pad comprising:

a body of refractory material capable of withstanding contact with molten steel, said body comprising a base having an impact surface for molten steel, an outer sidewall extending upwardly from the impact surface, said outer sidewall extending around said base to completely enclose said base, an annular body portion connected to said sidewall and providing a top surface substantially parallel to said impact surface and defining an opening into which molten steel can be poured;

said lower surface of said annular body portion and said inner face of said sidewall defining a recess having an undercut portion extending continuously around and above said impact surface; and wherein said top surface is at a lower level than the remainder of said top surface and said recess beneath said portion of said top surface is of smaller cross-section than the remainder of said recess.

2. A tundish impact pad according to claim 1 wherein said lower face of the annular body portion and said inner face of said sidewall provide a continuous curved surface which at its lower end merges into said impact surface of said base thereby providing around said base a concave recess having two discontinuities or steps one at each end of said smaller recess portion.

3. A tundish impact pad according to claim 1 wherein said pad is four-sided in plan view.

4. A tundish impact pad according to claim 3 wherein said paid has one pair of parallel sides defined by said outer surface of said sidewall.

5. A tundish impact pad according to claim 4 wherein said longer parallel side includes said first portion of said top surface and said smaller recess.

6. A tundish impact pad according to claim 3 wherein said pad is rectangular in plan view.

7. A tundish impact pad according to claim 1 wherein said smaller recess portion is not coterminous with the lower top surface portion.

8. A tundish impact pad according to claim 7 wherein said smaller recess portion does not extend as far as said ends of said lower top surface.

9. A tundish having an inlet zone adjacent a first end thereof and an outlet zone adjacent said opposite end thereof and an impact pad positioned on said floor of said tundish in said inlet zone;

said impact pad comprising a body of refractory material capable of withstanding contact with molten steel, said body comprising a base having an impact surface for molten steel, an outer sidewall extending upwardly from said impact surface, said outer sidewall extending around said base to completely enclose it, an annular body portion connected to said sidewall and providing a top surface substantially parallel to said impact surface and defining an opening into which molten steel can be poured, said lower surface of said annular body portion and said inner face of said sidewall defining a recess having an undercut portion extending continuously around and above said impact surface, wherein a portion of said top surface is at a lower level than said remainder of said top surface and said recess beneath said portion of the top surface is of smaller cross-section than said remainder of said recess; and wherein said pad is positioned with said portion of said top surface facing said first end of said tundish.

10. A tundish according to claim 9 wherein said impact pad is of wedge-shape and said longer parallel side of said pad is positioned facing said first end of said tundish.

11. A tundish according to claim 9 wherein said tundish is longitudinally-extending and of wedge shape in plan view.

12. A tundish according to claim 9 wherein said tundish is rectangular in plan view.

13. A tundish impact pad according to claim 2 wherein the pad is four-sided in plan view.

14. A tundish impact pad according to claim 13 wherein that the pad has one pair of parallel sides defined by the outer surface of the sidewall.

15. A tundish impact pad according to claim 2 wherein the smaller recess portion is not coterminous with the lower top surface portion.

16. A tundish impact pad according to claim 15 wherein the smaller recess portion does not extend as far as the ends of the lower top surface.

17. A tundish impact pad according to claim 14 wherein the smaller recess portion is not coterminous with the lower top surface portion.

18. A tundish impact pad according to claim 17 wherein the smaller recess portion does not extend as far as the ends of the lower top surface.

19. A tundish according to claim 10 wherein the tundish is longitudinally-extending and of wedge shape in plan view.

20. A tundish according to claim 10 wherein the tundish is rectangular in plan view.

* * * * *